US009284143B2

(12) United States Patent
Takahashi et al.

(10) Patent No.: US 9,284,143 B2
(45) Date of Patent: Mar. 15, 2016

(54) SHEET TRANSPORT DEVICE, AND IMAGE FORMING APPARATUS

(71) Applicant: FUJI XEROX CO., LTD., Tokyo (JP)

(72) Inventors: Kohei Takahashi, Kanagawa (JP); Toshikazu Takubo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/519,545

(22) Filed: Oct. 21, 2014

(65) Prior Publication Data

US 2015/0261166 A1 Sep. 17, 2015

(30) Foreign Application Priority Data

Mar. 13, 2014 (JP) ..... 2014-049660

(51) Int. Cl.
*B65H 5/38* (2006.01)
*B65H 1/26* (2006.01)

(52) U.S. Cl.
CPC ..... *B65H 5/38* (2013.01); *B65H 1/266* (2013.01); *B65H 2402/441* (2013.01); *B65H 2402/45* (2013.01); *B65H 2601/11* (2013.01)

(58) Field of Classification Search
CPC ..... B65H 1/266; B65H 5/062; B65H 5/36; B65H 5/38; B65H 29/52; B65H 29/125; B65H 2402/31; B65H 2402/40; B65H 2402/441; B65H 2402/44; B65H 2402/45; B65H 2601/11
See application file for complete search history.

(56) References Cited

U.S. PATENT DOCUMENTS

| | | | | |
|---|---|---|---|---|
| 7,162,182 | B2 * | 1/2007 | Tonges et al. | 399/110 |
| 7,596,341 | B2 * | 9/2009 | Yokoi | 399/124 |
| 9,037,073 | B2 * | 5/2015 | Aoyama | 399/392 |
| 2011/0236059 | A1 * | 9/2011 | Saito et al. | 399/110 |

FOREIGN PATENT DOCUMENTS

| | | | |
|---|---|---|---|
| JP | H06-16279 | A | 1/1994 |
| JP | 2009-242067 | A | 10/2009 |

* cited by examiner

*Primary Examiner* — Michael McCullough
(74) *Attorney, Agent, or Firm* — Oliff PLC

(57) ABSTRACT

Provided is a sheet transport device including a device main body on which one of a first transport roller pair that transports sheets is provided, an opening and closing door that is movably and rotatably supported between a closing position where a part of a sheet transport path formed on a side surface of the device main body is covered and an opening position where a part of the sheet transport path is open, and on which one of a second transport roller pair provided on the sheet transport path is provided, and a transport unit that includes another one of the first transport roller pair and another one of the second transport roller pair, and is swingably supported by the opening and closing door.

14 Claims, 9 Drawing Sheets

SHEET TRANSPORT DEVICE, AND IMAGE FORMING APPARATUS

CROSS-REFERENCE TO RELATED APPLICATIONS

This application is based on and claims priority under 35 USC 119 from Japanese Patent Application No. 2014-049660 filed Mar. 13, 2014.

BACKGROUND

Technical Field

The present invention relates to a sheet transport device, and an image forming apparatus.

SUMMARY

According to an aspect of the invention, there is provided a sheet transport device including:

a device main body on which one of a first transport roller pair that transports sheets is provided;

an opening and closing door that is movably and rotatably supported between a closing position where a part of a sheet transport path formed on a side surface of the device main body is covered and an opening position where a part of the sheet transport path is open, and on which one of a second transport roller pair provided on the sheet transport path is provided; and a transport unit that includes another one of the first transport roller pair and another one of the second transport roller pair, and is swingably supported by the opening and closing door, wherein, when the opening and closing door moves to the closing position from the opening position, the opening and closing door is positioned at a second positioning portion formed on the device main body after the transport unit is positioned at a first positioning portion formed on the device main body.

BRIEF DESCRIPTION OF THE DRAWINGS

Exemplary embodiments of the present invention will be described in detail based on the following figures, wherein.

DETAILED DESCRIPTION

Figure 1:
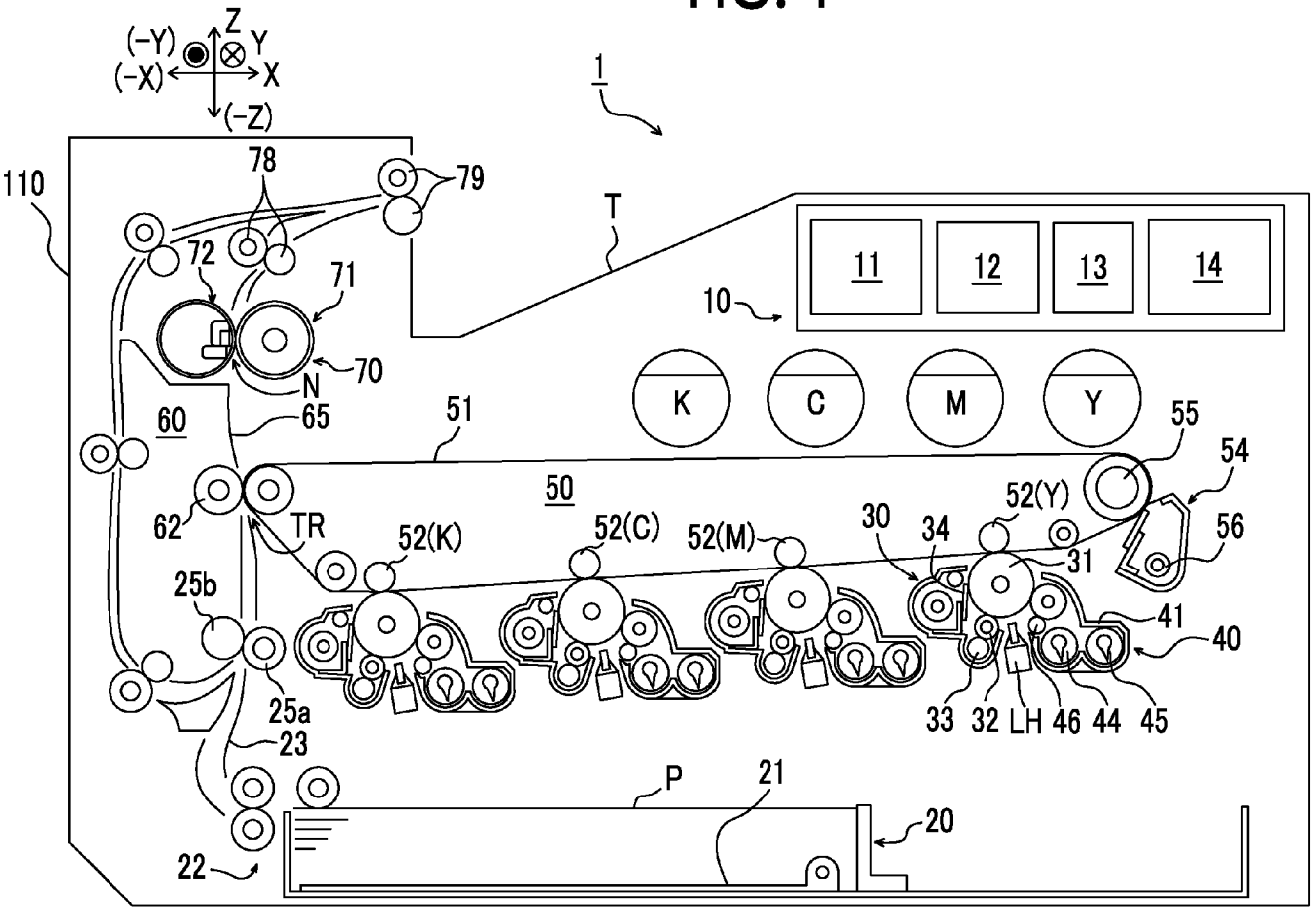
FIG. 1 is a vertical cross-sectional schematic diagram illustrating an internal configuration of an image forming apparatus.

Hereinafter, the present invention will be described in further detail with exemplary embodiments and detailed examples referring to the drawings. However, the present invention will not be limited to the exemplary embodiments or the detailed examples.

In addition, in the following description using the drawings, since the drawings are schematic drawings, it should be noted that the dimensions and the ratio of the drawings are different from those in reality, and the drawings of members other than those necessary for description for the sake of easy understanding are appropriately omitted.

To facilitate the easy understanding of the following description, it is assumed that a front-rear direction is set to an X-axis direction, a horizontal direction is set to a Y-axis direction, and a vertical direction is set to a Z-axis direction in the drawings.

1. Overall Configuration and Operation of the Image Forming Apparatus

FIG. 1 is a vertical cross-sectional schematic diagram illustrating an internal configuration of an image forming apparatus 1 in the present exemplary embodiment.

Hereinafter, the overall configuration and operation of the image forming apparatus 1 will be described with reference to the drawings.

The image forming apparatus 1 is configured to include a control device 10, a sheet feeding device 20, a photoconductor unit 30, a development unit 40, a transfer unit 50, a sheet transport unit 60, a fixing unit 70, and the like in a housing 100. On the upper surface (Z direction) of the image forming apparatus 1, a discharge tray unit T that discharges and accommodates the sheets on which an image is recorded is formed. Furthermore, on a side surface (−X direction) of the image forming apparatus 1, an opening and closing door 110 that opens the inside of the image forming apparatus 1 in a case of removal or checking of a sheet when the sheet is jammed is rotatably supported.

The control device 10 includes an image forming apparatus controller 11 that controls an operation of the image forming apparatus 1, a controller unit 12 that prepares an image data according to a request for printing, an exposure controller 13 that controls the illumination of an exposure head LH, and a power source device 14. The power source device 14 applies a high voltage to a charging roller 32 described below, a development roller 42, a primary image transfer roller 52, a secondary image transfer roller 62, and the like, and supplies power to the exposure head LH, the sheet feeding device 20, the fixing unit 70, each included sensor, and the like.

The controller unit 12 converts print information input from the external information transmission apparatus (for example, a personal computer, or the like) to image information for forming a latent image, and outputs a drive signal to the exposure head LH at a predetermined timing. The exposure head LH in the present exemplary embodiment is formed of an LED head in which a plural number of Light Emitting Diodes (LED) is linearly arranged along a main scanning direction.

At the bottom portion of the image forming apparatus 1, the sheet feeding device 20 is provided. The sheet feeding device 20 includes a sheet loading plate 21 and on the upper surface of the sheet loading plate 21, sheets P are loaded as a plural number of recording media. The sheets P which are loaded on the sheet loading plate 21 and of which the position in a width direction is determined by a regulating plate (not illustrated) are fed out one by one from the upper side in a frontward direction (−X direction) by a sheet drawer unit 22, and then, are transported to a nip portion of a registration roller pair 25 that is formed of a driving roller 25*a* and a driven roller 25*b* via a sheet guide 23.

The photoconductor units 30 are provided in the upward direction (Z direction) of the sheet feeding device 20 in parallel respectively, and include photosensitive drums 31 respectively as image holding members which rotate to drive. Along the rotation direction of the photosensitive drum 31, the charging roller 32, the exposure head LH, the development unit 40, the primary image transfer roller 52, and a cleaning blade 34 are disposed. In the charging roller 32, a cleaning roller 33 that cleans the surface of the charging roller 32 is disposed so as to face and to be in contact with the charging roller 32.

The development unit 40 includes a development housing 41 in which developer is accommodated. In the development housing 41, the development roller 42 that is disposed to face the photosensitive drum 31 and a pair of augers 44 and 45 that stirs and transports the developer to the development roller 42 side and are disposed on the back surface side diagonally below the development roller 42, are disposed. On the development roller 42, a layer regulating member 46 that regulates the thickness of the layer of the developer is closely disposed.

Each development unit 40 has substantially the same configuration except for the developer accommodated in the development housing 41, and forms a toner image of yellow (Y), magenta (M), cyan (C), and black (B) respectively.

The surface of the rotating photosensitive drum 31 is charged by the charging roller 32, and an electrostatic latent image is formed thereon by latent image forming light emitted from the exposure head LH. The electrostatic latent image formed on the photosensitive drum 31 is developed as a toner image by the development roller 42.

The transfer unit 50 includes an intermediate image transfer belt 51 on which the toner image of each color formed on the photosensitive drum 31 of the photoconductor unit 30 is multilayer transferred, and the primary image transfer roller 52 that sequentially transfers (primary transfer) the toner image of each color formed on the photoconductor unit 30 to the intermediate image transfer belt 51. The transfer unit 50 is configured to further include an intermediate image transfer belt cleaner 54 that removes the remaining toner attached on the intermediate image transfer belt 51.

The sheet transport unit 60 includes the driven roller 25*b* of a registration roller pair 25 that corrects the posture of the sheet P fed out from the sheet feeding device 20 and sends the sheet P to a secondary transfer portion TR at the timing of the secondary transfer, and the secondary image transfer roller 62 that collectively transfers (secondary transfer) the toner image of each color superimposed on the intermediate image transfer belt 51 to be transferred to the sheet P which is the recording medium. In addition, the sheet P on which the transferred toner image is held is guided to a fixing nip portion N of the fixing unit 70 via a transportation guide 65.

The toner image of each color formed on the photosensitive drum 31 of the photoconductor unit 30 is sequentially and electrostatically transferred (primary transfer) on the intermediate image transfer belt 51 by the primary image transfer roller 52 to which a predetermined transfer voltage is applied from the power source device 14 or the like controlled by the image forming apparatus controller 11, and the multilayer toner image on which toner of each color is superimposed is formed.

The multilayer toner image on the intermediate image transfer belt 51 is transported to the secondary transfer portion TR along with the movement of the intermediate image transfer belt 51. When the multilayer toner image is transported to the secondary transfer portion TR, the sheet P is supplied to the secondary transfer portion TR from the registration roller pair 25 in accordance with the timing.

Then, the predetermined transfer voltage is applied to the secondary image transfer roller 62 from the power source device 14 or the like controlled by the image forming apparatus controller 11, and the multilayer toner image on the intermediate image transfer belt 51 is collectively transferred to the sheet P sent out from the registration roller pair 25 and guided by the sheet guide 23.

The toner remaining on the surface of the photosensitive drum 31 is removed by the cleaning blade 34 and is collected in the waste toner container (not illustrated). The surface of the photosensitive drum 31 is recharged by the charging roller 32. The residue that is not removed by the cleaning blade 34 and is attached to the charging roller 32 is captured and stored on the surface of the cleaning roller 33 that rotates while being in contact with the charging roller 32.

The fixing unit 70 includes a heating module 71 and a pressure module 72, and the fixing nip N (fixing area) is formed by the pressure contact area of the heating module 71 and the pressure module 72.

The sheet P on which the toner image is transferred in the secondary transfer portion TR is transported to the fixing unit 70 via the transportation guide 65 in a state in which the toner image is not fixed. On the sheet P transported to the fixing unit 70, the toner image is fixed by a pressing and heating operation by a pair of the heating module 71 and the pressure module 72.

The sheet P on which the fixed toner image is formed is discharged to a discharge tray portion T on the upper surface of the image forming apparatus 1 from a discharge roller pair 79 via a transport roller pair 78. In addition, in a case of a duplex printing, at a point in time when the trailing end of the sheet P of which the front surface is fixed passes the transport roller pair 78, the discharge roller pair 79 reversely drives and the sheet P is transported to the registration roller pair 25 from a reverse transport path formed in the opening and closing door 110, and then the image is formed on the rear surface.

2. Configuration and Operation of Sheet Transport Section

Figure 2:
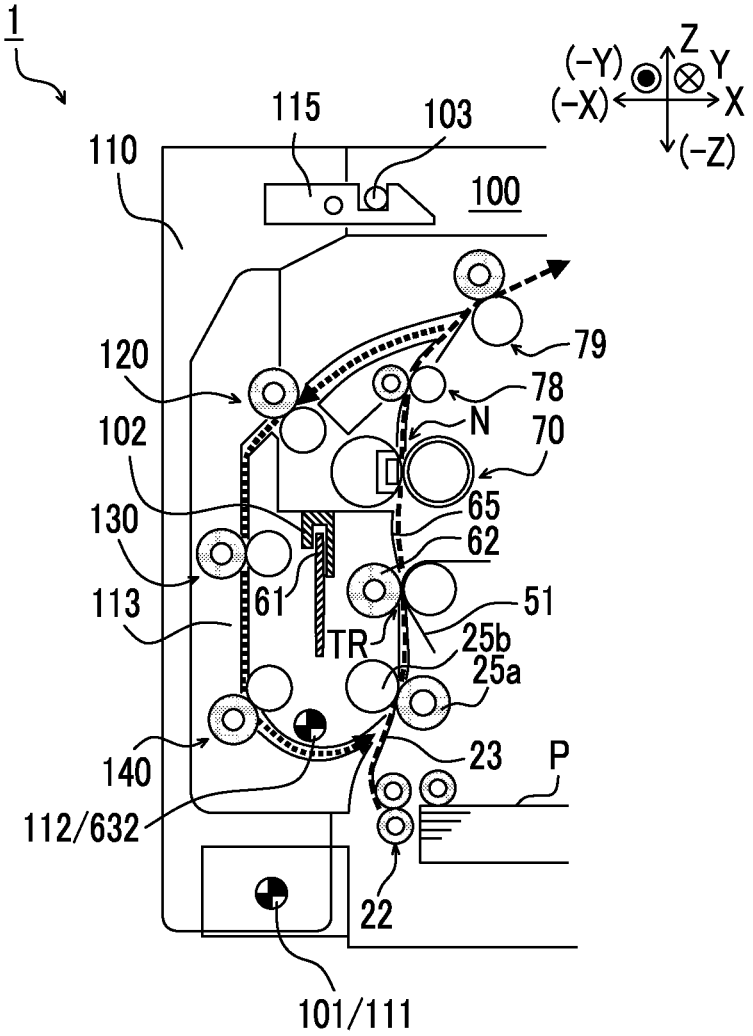
FIG. 2 is a cross-sectional schematic diagram illustrating an internal configuration of a sheet transport section and a sheet transport of the image forming apparatus.
Figure 3:
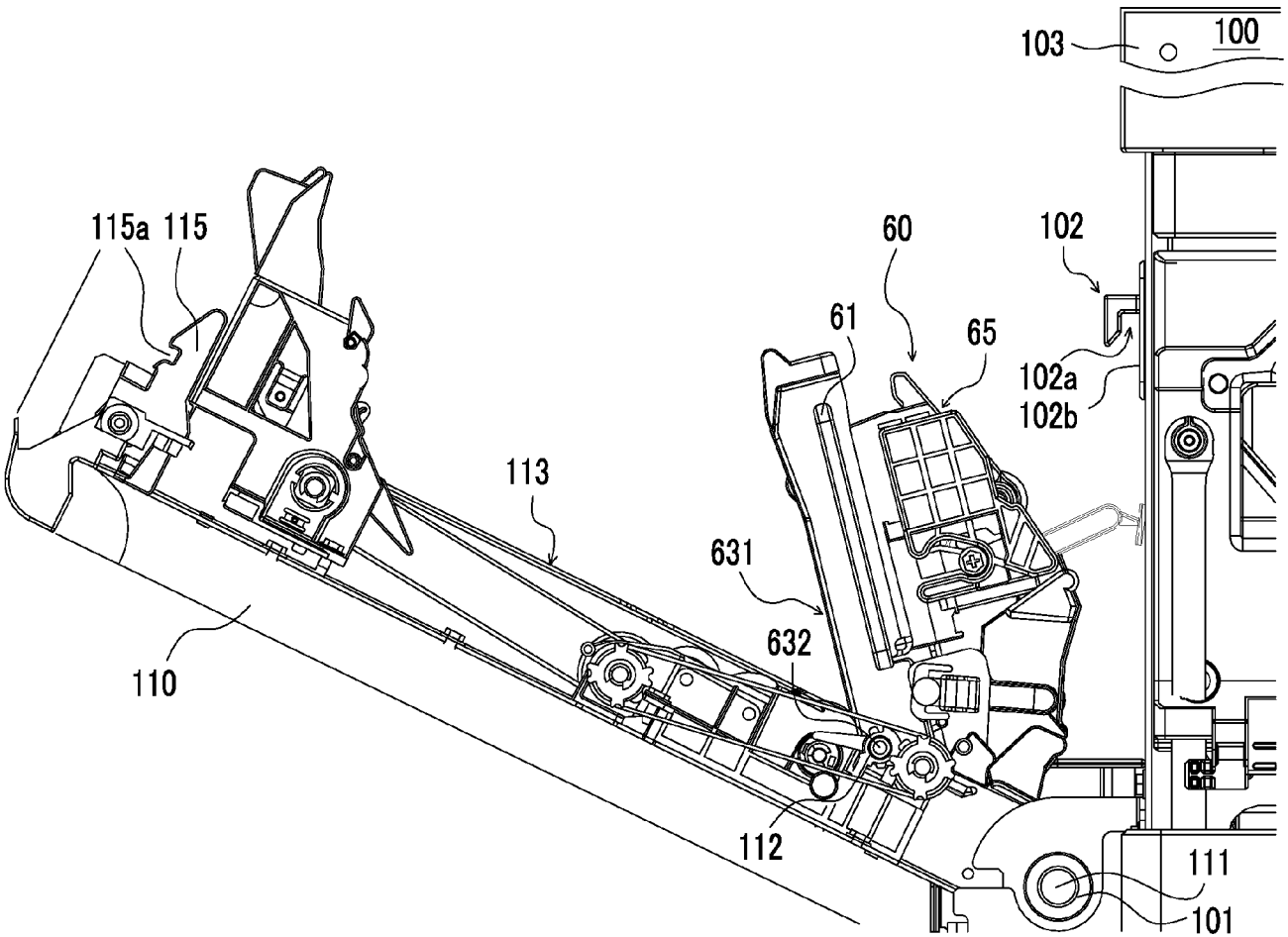
FIG. 3 is a schematic diagram illustrating a position relationship between an opening and closing door and a sheet transport unit when the sheet transport section of the image forming apparatus is open.
Figure 4:
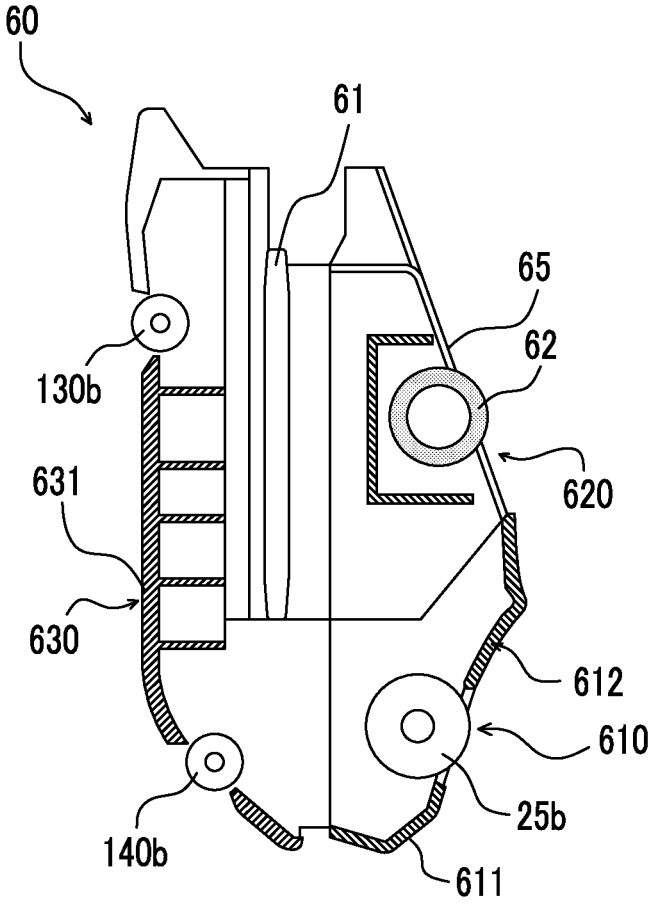
FIG. 4 is a cross-sectional schematic diagram illustrating the sheet transport unit.
Figure 5A:
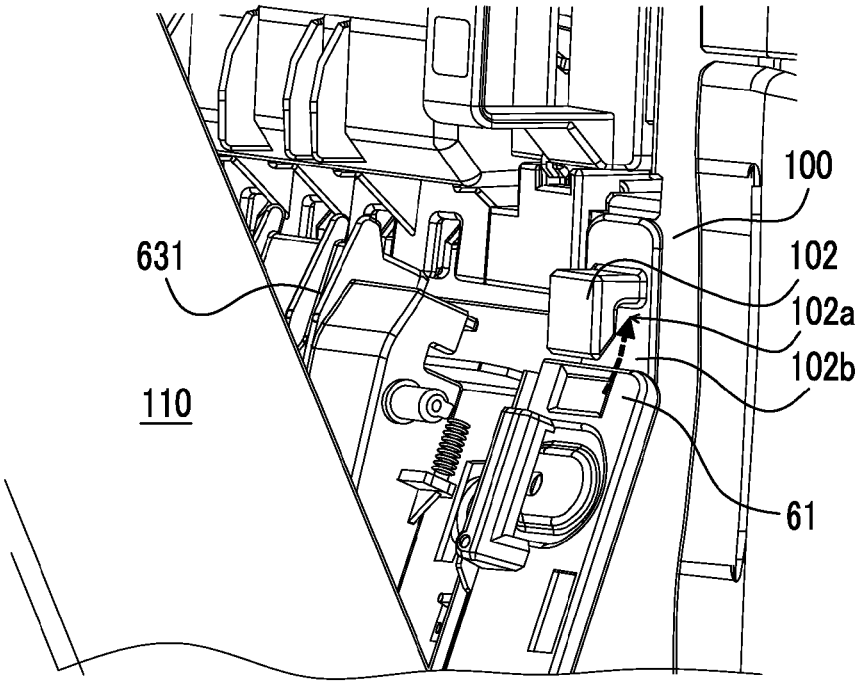
FIG. 5A and FIG. 5B are perspective views explaining an engagement of the sheet transport unit to a housing.
Figure 5B:
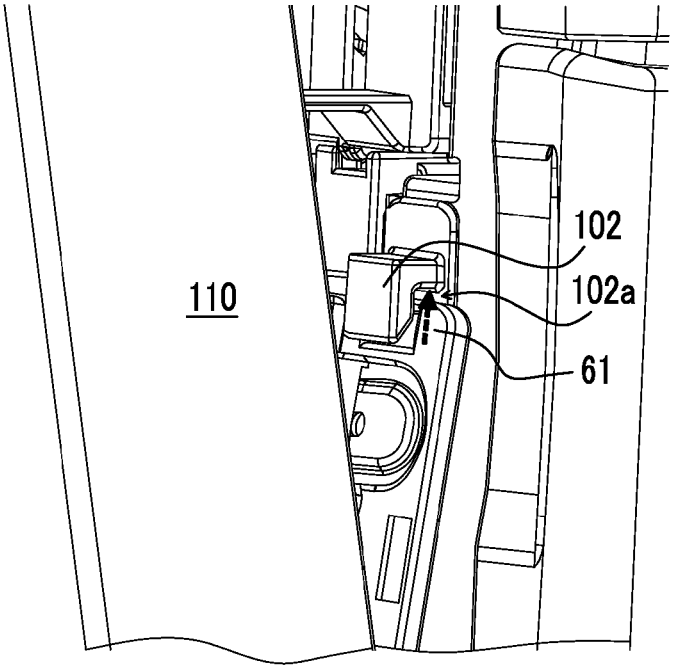
Figure 6:
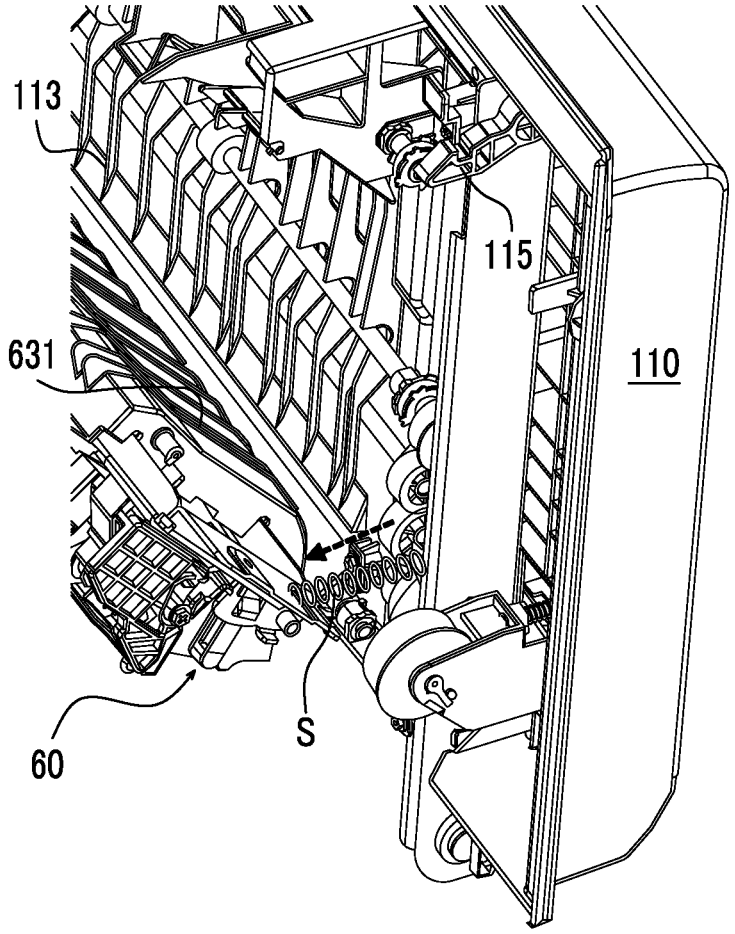
FIG. 6 is a perspective view explaining an opening mechanism of the sheet transport unit and the opening and closing door.
Figure 7:
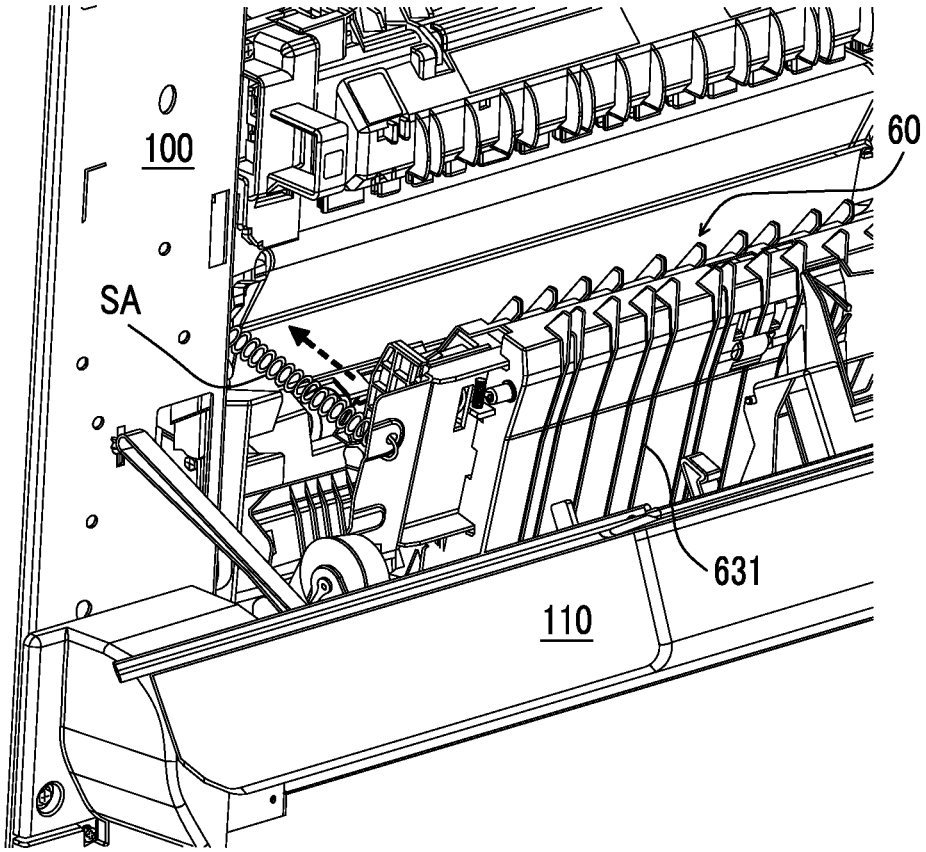
FIG. 7 is a perspective view explaining a modification example of an opening mechanism of the sheet transport unit and the opening and closing door.

FIG. 2 is a cross-sectional schematic diagram illustrating an internal configuration of a sheet transport section and the sheet transport of the image forming apparatus 1; FIG. 3 is a schematic diagram illustrating a position relationship between the opening and closing door 110 and the sheet transport unit 60 when the sheet transport section of the image forming apparatus 1 is open; FIG. 4 is a cross-sectional schematic diagram illustrating the sheet transport unit 60; FIG. 5A and FIG. 5B are perspective views explaining an engagement of the sheet transport unit 60 to the housing 100; FIG. 6 is a perspective view explaining an opening mechanism of the sheet transport unit 60 and the opening and closing door 110; and FIG. 7 is a partial cross-sectional schematic diagram of the sheet transport section, which is a perspective view explaining a modification example of an opening mechanism of the sheet transport unit 60 and the opening and closing door 110.

Hereinafter, a configuration and an operation of a sheet transport section of the image forming apparatus 1 will be described with reference to the drawings.

The sheet transport section is configured to include the housing 100, the opening and closing door 110, and the sheet transport unit 60.

2.1 Housing

The housing 100 includes an opening portion in a side direction (−X direction), and the photoconductor unit 30, the development unit 40, the transfer unit 50, and the like are accommodated therein.

At the lower end of the opening portion side of the housing 100, a first bearing portion 101 which is a rotation center of the opening and closing door 110 is formed, and the first bearing portion 101 rotatably supports a rotating shaft portion 111 of the opening and closing door 110 described below.

On the upper part of the opening portion of the housing 100, an engaging portion 102 as an example of a first positioning portion is formed. The engaging portion 102 includes an opening portion 102*a* in a downward direction (−Z direction). A base portion 61 described below as an example of a plate-shaped retaining portion provided on the sheet transport unit 60 enters the opening portion 102*a* and then, the sheet transport unit 60 is engaged with the image forming apparatus 1 main body.

In addition, the entire engaging portion 102 is formed integrally with a planar-shaped bottom surface portion 102*b*, and is fixed on a surface facing the sheet transport unit 60 in the housing 100, and thus, the bottom surface portion 102*b* is a guiding surface of the base portion 61 when the sheet transport unit 60 rotatably moves along with the opening and closing of the opening and closing door 110.

On the further upward direction (Z direction) of the housing 100 on which the engaging portion 102 is fixed, a lock pin 103 as an example of a second positioning portion is provided to protrude in a direction crossing the opening and closing direction of the opening and closing door 110.

Then, the opening and closing door 110 to which a recessed portion 115*a* of an engaging lever 115 swingably provided on the upper portion of the opening and closing door 110 is fixed to the housing 100 in a state where the opening and closing door 110 closes the opening portion of the housing 100.

2.2 Opening and Closing Door

In the opening and closing door 110, the sheet transport unit 60 described below is rotatably supported, and the rotating shaft portion 111 is supported by the first bearing portion 101 of the housing 100. Then, the opening and closing door 110 rotatably moves between the closing position which closes the opening portion of the housing 100 and the opening position which opens the opening portion.

In the inner surface of the opening and closing door 110 facing the housing 100, an outer side transportation guide 113 that is one side of the reverse transport path through which the sheet P of which the transport direction is reversed after the front surface is fixed is passing until joining the registration roller pair 25 again, is formed.

The outer side transportation guide 113 forms the reverse transport path keeping a predetermined gap between itself and an inner side transportation guide 631 formed on the sheet transport unit 60 described below.

In the reverse transport path, a plural number of transport roller pairs 120, 130, and 140 are disposed, and in the outer side transportation guide 113, drive side transport rollers 120*a*, 130*a*, and 140*a* that configure the transport roller pairs 120, 130, and 140 are disposed.

2.3 Sheet Transport Unit

The sheet transport unit 60 is configured to include a register unit portion 610, a secondary transfer unit portion 620, and a duplex unit portion 630.

The register unit portion 610 includes a first sheet guide 611, the driven roller 25*b* which is one roller of the registration roller pair 25, and a second sheet guide 612. The driving roller 25*a* which is the other roller of the registration roller pair 25 is disposed on the apparatus body side.

The first sheet guide 611 guides the sheet P fed from the sheet feeding device 20 and the sheet P transported via the duplex unit portion 630 to the nip portion of the registration roller pair 25. The second sheet guide 612 guides the sheet P, the posture of which is corrected and sent out from the registration roller pair 25, to the secondary transfer portion TR.

The secondary transfer unit portion 620 includes a housing 621, the secondary image transfer roller 62, and a transportation guide 65, and collectively transfers (secondary transfer) the toner image held on the intermediate image transfer belt 51, in the secondary image transfer roller 62 urged to the intermediate image transfer belt 51 side in the housing 621, on the sheet P sent in accordance with the timing of the secondary transfer. The sheet P on which the toner image is transferred is guided to the fixing nip portion N of the fixing unit 70 via the transportation guide 65.

The duplex unit portion 630 includes the inner side transportation guide 631 that is opposed to the outer side transportation guide 113 formed on the inner surface side of the opening and closing door 110, and configures the other surface side of the reverse transport path, and transports the sheet P, both sides of which are to be printed on, to the registration roller pair 25.

On the inner side transportation guide 631, a pinch roller 130*b* of the transportroller pair 130 and a pinch roller 140*b* of the transport roller pair 140 are rotatably disposed respectively.

In addition, on the lower side of the inner side transportation guide 631, a rotating shaft portion 632 are formed as a pair in the right and left side. The rotating shaft portion 632 is inserted into a second bearing portion 112 formed on both side plates 110*a* of the opening and closing door 110, and the sheet transport unit 60 is rotatably supported with respect to the opening and closing door 110.

As illustrated in FIG. 6, one end of a compression coil spring S as an example of an elastic member is fixed to both sides of the inner side transportation guide 631, and the other end thereof is fixed to an inner surface side facing the inner side transportation guide 631 of the opening and closing door 110. Then, when the opening and closing door 110 is fixed in the closing position, an urging force of the compression coil spring S mutually acts between the sheet transport unit 60 and the opening and closing door 110.

For this reason, when the opening and closing door 110 releases the engagement of the engaging lever 115 to the housing 100 and moves to the opening position, in accordance with the movement of the opening and closing door 110, the sheet transport unit 60 rotatably supported with the rotating shaft portion 632 as a center with respect to the opening and closing door 110 moves from the engaging portion 102 in the downward direction (−Z direction) along the bottom surface portion 102*b* provided on the housing 100 and the engagement is released.

As a result, with the release of the nip of the registration roller pair 25, the inner side transportation guide 631 that forms the reverse transport path and the outer side transportation guide 113 are mutually opened by the urging force of the compression coil spring S, and thus, the nips of the transport roller pair 120, 130, and 140 are also released.

Modification Example

As illustrated in FIG. 7, in the sheet transport unit 60, one end of a tension coil spring SA as an example of an elastic member may be fixed to both sides of the inner side transportation guide 631 instead of the compression coil spring S, and the other end thereof may be fixed to the inner surface side facing the sheet transport unit 60 of the housing 100 to support the sheet transport unit 60.

According to the modification example, the sheet transport unit 60 in which the engagement with the engaging portion 102 provided in the housing 100 is released rotatably moves together with the movement of the opening and closing door 110, and is held in the middle of the rotational movement by the tension force of the tension coil spring SA. Then, by the opening and closing door 110 further rotatably moving, the inner side transportation guide 631 that forms the reverse transport path and the outer side transportation guide 113 are mutually opened, and the nips of the transportroller pair 120, 130, and 140 are released.

3. Action of the Sheet Transport Section

In the sheet transport section configured in this way, for example, in a case where a user removes a jammed sheet which occurred in the sheet transport section, the nip of the registration roller pair 25 is released by the sheet transport unit 60 moving in the downward direction from the housing 100 and rotating together with the opening operation of the opening and closing door 110. In addition, the engagement between the outer side transportation guide 113 that forms the reverse transport path and the inner side transportation guide 631 provided on the duplex unit portion 630 of the sheet transport unit 60 is released, and thus, the nips of the transportroller pair 130 and 140 are also released.

Figure 8:
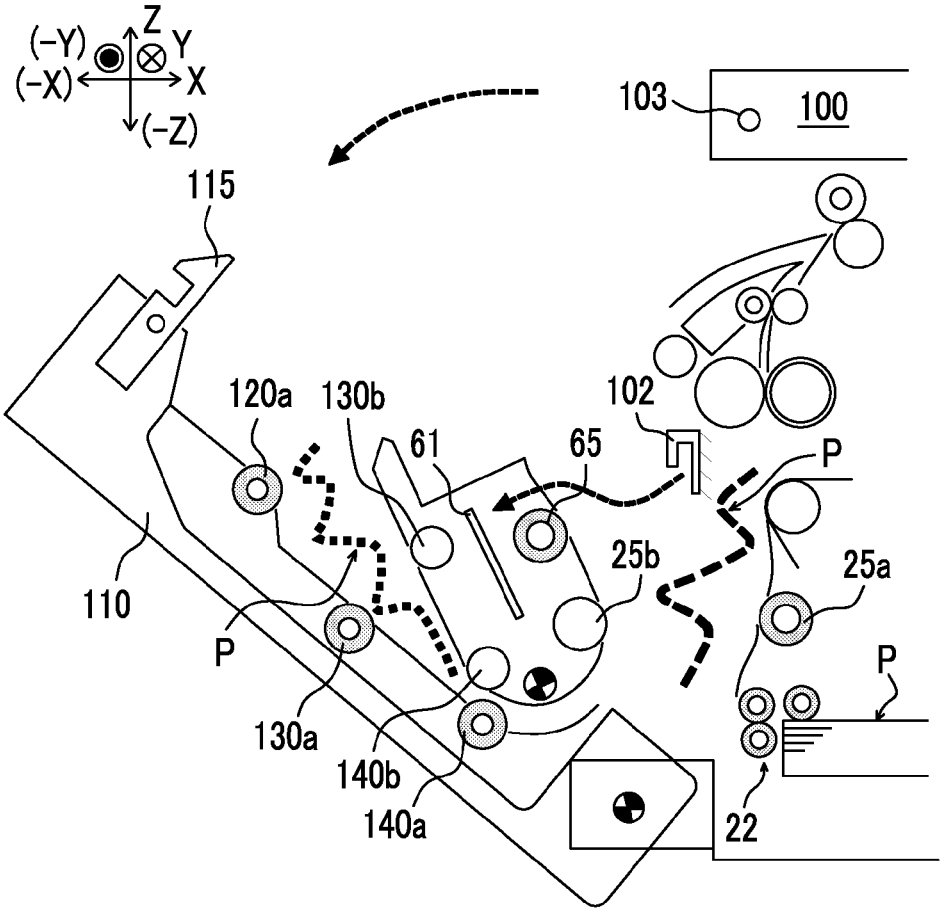
FIG. 8 is a partial schematic diagram explaining a moving of the sheet transport unit by an opening operation of the opening and closing door.
Figure 9:
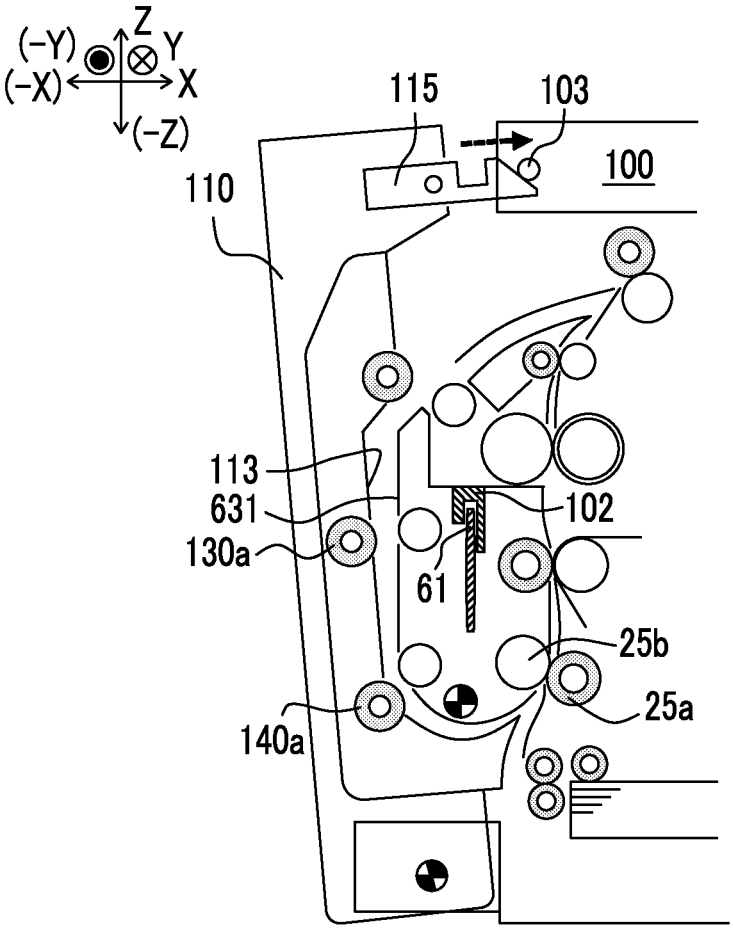
FIG. 9 is an overall schematic diagram explaining a moving of the sheet transport unit by a closing operation of the opening and closing door.

FIG. 8 is a schematic diagram of the sheet transport section explaining moving of the sheet transport unit 60 by an opening operation of the opening and closing door 110, and FIG. 9 is a schematic diagram of the sheet transport section explaining moving of the sheet transport unit 60 by a closing operation of the opening and closing door 110.

Hereinafter, the removing of the jammed sheet in the sheet transport section will be described with reference to the drawings.

3.1 Opening Operation of Opening and Closing Door

In a case where the opening and closing door 110 moves from the closing position to the opening position, the user releases the engagement with the lock pin 103 provided in the housing 100 by pulling up the engaging lever 115 provided on the upper portion of the opening and closing door 110, and then causes the opening and closing door 110 to rotatably move toward the side of the image forming apparatus 1 main body (−X direction in FIG. 1).

The engaging portion 102 formed on the upper portion of the opening portion side of the housing 100 includes the opening portion 102*a* in the downward direction (−Z direction), and the base portion 61 provided on the sheet transport unit 60 is guided to the lower portion while being in contact with the bottom surface portion 102*b* of the engaging portion 102 along with the movement of the opening and closing door 110, and thus, the engagement between the sheet transport unit 60 and the engaging portion 102 of the housing 100 is released.

Then, when the opening and closing door 110 is further rotatably moved to the side, the sheet transport unit 60 which is rotatably supported on the opening and closing door 110 rotatably moves together with the movement of the opening and closing door 110, the nip of the registration roller pair 25 is released, and thus, the nip of the secondary image transfer roller 62 and the intermediate image transfer belt 51 in the secondary transfer portion TR is also released.

In addition, the inner side transportation guide 631 of the duplex unit portion 630 that forms the reverse transport path and the outer side transportation guide 113 of the opening and closing door 110 are mutually opened by the urging force of the compression coil spring S, and thus, the transport roller pairs 130 and 140 are also released.

As a result, in a case where the sheet P which is fed out from the sheet feeding device 20 is jammed between the transfer unit 50 and the sheet transport unit 60, it is possible for the user to easily remove the jammed sheet.

In addition, at the time of duplex printing, in a case where the sheet P being transported through the reverse transport path is jammed in the reverse transport path, the portion between the inner side transportation guide 631 which forms the reverse transport path and the outer side transportation guide 113 is opened, and thus, the jammed sheet P may easily be visually recognized and it is possible to remove the jammed sheet.

3.2 Closing Operation of Opening and Closing Door

In a case where the opening and closing door 110 returns to the closing position from the opening position, the user causes the opening and closing door 110 to rotatably move to the housing 100 side.

Along with the rotatable movement of the opening and closing door 110 to the housing 100 side, the sheet transport unit 60 which is rotatably supported by the opening and closing door 110 also rotatably moves to the housing 100 side. Then, the base portion 61 of the sheet transport unit 60 is guided to the upward direction (Z direction) while being in contact with the bottom surface portion 102*b* of the engaging portion 102 provided on the upper portion of the opening portion side of the housing 100, and the position of the base portion 61 of the sheet transport unit 60 is determined by being engaged in the engaging portion 102 having the opening portion 102*a* in the downward direction (−Z direction).

If the opening and closing door 110 is further rotatably moved with respect to the housing 100 in a state where the sheet transport unit 60 is engaged in the engaging portion 102 of the housing 100, the recessed portion 115*a* of the engaging lever 115 which is swingably provided on the upper portion of the opening and closing door 110 is fit to the lock pin 103 provided on the housing 100, then, the opening and closing door 110 is fixed in a state of closing the opening portion of the housing 100.

In this way, in a case where the opening and closing door 110 returns to the closing position from the opening position, the sheet transport unit 60 that configures the sheet transport section and the opening and closing door 110 that includes the outer side transportation guide 113 which configures one surface of the reverse transport path are engaged with the housing 100 respectively, and thus, there is no such case in which the contact timing of the reaction force simultaneously acts on the opening and closing door 110.

For this reason, the contact reaction force which acts on the opening and closing door 110 is distributed, and it is possible to easily perform the closing operation of the opening and closing door 110. In addition, when the opening and closing door 110 moves to the closing position, the reaction force received from the sheet transport unit 60 is distributed, and thus, it is possible to prevent the damage to the opening and closing door 110.

In this case where the opening and closing door 110 is engaged to the housing 100 and positioned at the closing position, the sheet transport unit 60 receives the reaction force by the nip of the registration roller pair 25 and the nip of the secondary image transfer roller 62 in the secondary transfer portion TR. However, since the housing 100 and the sheet transport unit 60 are engaged by the engaging portion 102 and the position is determined, there is no such case in which the reaction force received by the sheet transport unit 60 acts on the outer side transportation guide 113 of the opening and closing door 110.

Therefore, it is possible to suppress the deformation of the outer side transportation guide 113 without the reaction force received by the sheet transport unit 60 via the transport roller pair 130 and 140 in the reverse transport path acting on the outer side transportation guide 113.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport device comprising:

a device main body on which one roller of a first transport roller pair that transports sheets is provided;

an opening and closing door that is movably and rotatably supported between a closing position where a part of a sheet transport path formed on a side surface of the device main body is covered and an opening position where a part of the sheet transport path is open, and on which one roller of a second transport roller pair provided on the sheet transport path is provided; and a transport unit that includes an other one of the first transport roller pair and an other one of the second transport roller pair, and is swingably supported by the opening and closing door, wherein, when the opening and closing door moves to the closing position from the opening position, the opening and closing door is positioned at a second positioning portion formed on the device main body after the transport unit is positioned at a first positioning portion formed on the device main body, wherein the first positioning portion is an engaging portion that includes an opening portion and a bottom surface portion, the bottom surface portion being in contact with a base portion of the transport unit, thereby allowing engagement between the transport unit and the engaging portion to ultimately be released with the movement of the opening and closing door.

2. The sheet transport device according to claim 1, wherein the base portion is a plate-shaped retaining portion that is provided on an inner surface facing the device main body, and when the opening and closing door moves to the closing position, the retaining portion is engaged to an opening portion formed on the first positioning portion to be positioned.

3. The sheet transport device according to claim 2, wherein when the opening and closing door moves to the opening position from the closing position, the retaining portion is guided to the bottom surface portion and is separated from the first positioning portion, and the transport unit rotates in a moving direction of the opening and closing door to separate the first transport roller pair from each other and to separate the second transport roller pair from each other.

4. The sheet transport device according to claim 3, wherein the transport unit is urged by an elastic member, one end of which is fixed to an inner surface side of the opening and closing door facing the transport unit, and another end of which is fixed to an outer surface side of the transport unit facing the opening and closing door, and separates the second transport roller pair from each other when the opening and closing door moves from the closing position to the opening position.

5. The sheet transport device according to claim 2, wherein the transport unit is urged by an elastic member, one end of which is fixed to an inner surface side of the opening and closing door facing the transport unit, and another end of which is fixed to an outer surface side of the transport unit facing the opening and closing door, and separates the second transport roller pair from each other when the opening and closing door moves from the closing position to the opening position.

6. The sheet transport device according to claim 2, wherein the transport unit is urged by an elastic member, one end of which is fixed to an inner surface side of the main body facing the transport unit, and another end of which is fixed to an inner surface side of the transport unit facing the main body, and separates the second transport roller pair from each other when the opening and closing door moves from the closing position to the opening position.

7. The sheet transport device according to claim 3, wherein the transport unit is urged by an elastic member, one end of which is fixed to an inner surface side of the main body facing the transport unit, and another end of which is fixed to an inner surface side of the transport unit facing the main body, and separates the second transport roller pair from each other when the opening and closing door moves from the closing position to the opening position.

8. An image forming apparatus comprising:

the sheet transport device according to claim 2; and an image forming section that forms an image on a recording medium transported by the sheet transport device.

9. The sheet transport device according to claim 1, wherein when the opening and closing door moves to the opening position from the closing position, the base portion is guided to the bottom surface portion and is separated from the first positioning portion, and the transport unit rotates in a moving direction of the opening and closing door to separate the first transport roller pair from each other and to separate the second transport roller pair from each other.

10. The sheet transport device according to claim 9, wherein the transport unit is urged by an elastic member, one end of which is fixed to an inner surface side of the opening and closing door facing the transport unit, and another end of which is fixed to an outer surface side of the transport unit facing the opening and closing door, and separates the second transport roller pair from each other when the opening and closing door moves from the closing position to the opening position.

11. The sheet transport device according to claim 9, wherein the transport unit is urged by an elastic member, one end of which is fixed to an inner surface side of the main body facing the transport unit, and another end of which is fixed to an inner surface side of the transport unit facing the main body, and separates the second transport roller pair from each other when the opening and closing door moves from the closing position to the opening position.

12. The sheet transport device according to claim 1, wherein the transport unit is urged by an elastic member, one end of which is fixed to an inner surface side of the opening and closing door facing the transport unit, and another end of which is fixed to an outer surface side of the transport unit facing the opening and closing door, and separates the second transport roller pair from each other when the opening and closing door moves from the closing position to the opening position.

13. The sheet transport device according to claim 1, wherein the transport unit is urged by an elastic member, one end of which is fixed to an inner surface side of the main body facing the transport unit, and another end of which is fixed to an inner surface side of the transport unit facing the main body, and separates the second transport roller pair from each other when the opening and closing door moves from the closing position to the opening position.

14. An image forming apparatus comprising:

the sheet transport device according to claim 1; and an image forming section that forms an image on a recording medium transported by the sheet transport device.

* * * * *